US010648105B2

(12) United States Patent
Kim et al.

(10) Patent No.: US 10,648,105 B2
(45) Date of Patent: May 12, 2020

(54) NANOFIBER BASED COMPOSITE FALSE TWIST YARN AND MANUFACTURING METHOD THEREFOR

(71) Applicants: AMOGREENTECH CO., LTD., Gimpo-si (KR); KOREA INSTITUTE FOR KNIT INDUSTRY, Iksan-si (KR)

(72) Inventors: Chan Kim, Gwangju (KR); Seung Hoon Lee, Paju-si (KR); Jong Su Seok, Suwon-si (KR); Jung Jae Ryu, Gwangju (KR); Do Hwan Kim, Jeonju-si (KR)

(73) Assignees: AMOGREENTECH CO., LTD., Gyeonggi-Do (KR); KOREA INSTITUTE FOR KNIT INDUSTRY, Iksan-si (KR)

( * ) Notice: Subject to any disclaimer, the term of this patent is extended or adjusted under 35 U.S.C. 154(b) by 192 days.

(21) Appl. No.: 15/747,307

(22) PCT Filed: Jul. 29, 2015

(86) PCT No.: PCT/KR2015/007917
§ 371 (c)(1),
(2) Date: Jan. 24, 2018

(87) PCT Pub. No.: WO2017/018558
PCT Pub. Date: Feb. 2, 2017

(65) Prior Publication Data

US 2018/0216258 A1 Aug. 2, 2018

(30) Foreign Application Priority Data

Jul. 28, 2015 (KR) ..... 10-2015-0106652

(51) Int. Cl.
*D02G 1/02* (2006.01)
*D02G 3/04* (2006.01)
(Continued)

(52) U.S. Cl.
CPC ..... *D02G 1/0206* (2013.01); *B65H 21/00* (2013.01); *D01D 5/0038* (2013.01); *D01D 5/247* (2013.01);
(Continued)

(58) Field of Classification Search
CPC .. D02G 1/02; D02G 3/04; D02G 3/22; D02G 3/26; D02G 1/0206; D02G 3/36; D01D 5/0007
See application file for complete search history.

(56) References Cited

U.S. PATENT DOCUMENTS

2008/0170982 A1* 7/2008 Zhang ..... B82Y 10/00 423/447.3
2016/0024262 A1* 1/2016 Lu ..... C08J 5/042 523/222

FOREIGN PATENT DOCUMENTS

JP 04144868 5/1992
KR 20110035454 4/2011
(Continued)

OTHER PUBLICATIONS

International Search Report—PCT/KR2015/007917 dated Apr. 28, 2016.

*Primary Examiner* — Tajash D Patel
(74) *Attorney, Agent, or Firm* — Cantor Colburn LLP

(57) ABSTRACT

Provided is a nanofiber based composite false twist yarn that is obtained by producing a nanofiber tape yarn by precisely slitting a nanofiber membrane produced by electrospinning and then twisting a nanofiber-only twist yarn that is obtained by twisting the nanofiber tape yarn or composite-twisting a nanofiber-only twist yarn and a natural fiber or synthetic fiber. The nanofiber based composite false twist yarn includes: a nanofiber tape yarn including at least one bonding portion or a false twist yarn which is obtained by false twisting the nanofiber tape yarn; and a natural fiber yarn or
(Continued)

a synthetic fiber yarn that is composite-false-twisted with the nanofiber tape yarn or the false twist yarn, wherein the nanofiber tape yarn is made of a nanofiber web that is obtained by integrating polymer nanofibers made of a fiber-forming polymer material and having an average diameter of less than 1 μm thereby having fine pores.

15 Claims, 10 Drawing Sheets

(51) Int. Cl.

| | |
|---|---|
| ***D02G 3/26*** | (2006.01) |
| ***D04H 1/728*** | (2012.01) |
| ***D01D 5/247*** | (2006.01) |
| ***D01D 5/00*** | (2006.01) |
| ***B65H 21/00*** | (2006.01) |
| ***D01D 5/42*** | (2006.01) |
| ***D02G 3/06*** | (2006.01) |
| ***D04H 3/007*** | (2012.01) |
| ***D04H 3/16*** | (2006.01) |
| *D01F 6/12* | (2006.01) |

(52) U.S. Cl.

CPC ..... *D01D 5/426* (2013.01); *D02G 1/02* (2013.01); *D02G 1/0293* (2013.01); *D02G 3/04* (2013.01); *D02G 3/06* (2013.01); *D02G 3/26* (2013.01); *D04H 1/728* (2013.01); *D04H 3/007* (2013.01); *D04H 3/16* (2013.01); *D01F 6/12* (2013.01); *D10B 2321/042* (2013.01)

(56) References Cited

FOREIGN PATENT DOCUMENTS

| | | |
|---|---|---|
| KR | 20110047340 | 5/2011 |
| KR | 20130013843 | 2/2013 |
| KR | 20130027690 | 3/2013 |
| WO | 2009131149 | 10/2009 |

* cited by examiner

NANOFIBER BASED COMPOSITE FALSE TWIST YARN AND MANUFACTURING METHOD THEREFOR

TECHNICAL FIELD

The present invention relates to a nanofiber based composite false twist yarn that is obtained by producing a nanofiber tape yarn by precisely slitting a nanofiber membrane produced by electrospinning and then twisting a nanofiber-only twist yarn that is obtained by twisting the nanofiber tape yarn or composite-twisting a nanofiber-only twist yarn and a natural fiber or synthetic fiber, and a method of manufacturing the same.

BACKGROUND ART

Generally, in the textile industry, nanofibers refer to fibers whose diameter is less than or equal to 1 μm, which is the limiting diameter of a conventional spinning process. The nanofibers can be produced by a variety of methods including drawing, template synthesis, self-assembly, chemical vapor deposition (CVD), phase separation, electrospinning, and hybridization of the conventional spinning process. Among these methods, electrospinning is a nanofiber manufacturing method that is in the most widely researched field in terms of mass productivity, handling properties, selection of various raw materials, wide application and processing, and that is in an early stage of industrialization through success of mass production and convergence with existing materials.

The electrospinning technique involves applying a high voltage to a polymer solution or melt and spraying the polymer solution onto a charged surface with a negative pole or earth, during which a solvent is volatized while nanofiber shaped materials are manufactured by being laminated in a web or non-woven state. Such a nanofiber web is a non-woven fabric composed of fibers having a diameter of less than 1 μm, and has a porosity of 60% to 90% and an average pore size of 0.2 μm to 1.0 μm according to the diameter and thickness of the fibers. However, nanofiber webs are generally poor in handleability when applied in industry, and have poor physical properties such as tension and tensile strength. Therefore, they are used in combination with existing materials to form secondary battery membrane materials, environmental purification filter materials, membrane materials for clothing, medical materials, etc. However, considering the inherent physical properties of the non-woven fabric made of nanofibers, it has been limited to be widely used for high strength materials and various application fields.

Therefore, when a filament yarn composed of nanofibers is manufactured, it is possible to manufacture a variety of secondary work pieces such as weaving, knitting, mesh, and rope, thereby greatly expanding the use of the nanofibers.

Synthetic or natural fibers are twisted to increase the strength of the yarn and to improve the weaving and knitting properties by imparting tactile, elastic, and bulk properties to the yarn. The synthetic fibers may be classified into mono filaments or multifilaments, and the natural fibers may be classified into low twist yarns to crepe hard twist yarns, depending on the material and the turns of twists, while imparting twists to the yarn in the form of spun yarns.

However, in the case of such synthetic fibers and natural fibers, the fibers are composed of several to several tens of micrometers in diameter, and are several ten times or several thousand times as thick as those of electrospun nanofibers.

Therefore, when yarns are twisted in the same material and the same thickness, the nanofibers have a high porosity, so that the structures such as weaving and knitted fabric can be easily lightened and the contact area can be improved by using a high surface area. Therefore, the waterproof and breathable functions can be made convenient.

Therefore, when a composite false twist yarn made of nanofibers is manufactured, it becomes possible to manufacture various kinds of secondary work pieces or structures such as weaving, knitting, mesh, and rope, and thus the use of the nanofiber can be greatly expanded as a base material.

As a conventional technology relating to such a composite false twist yarn, Korean Patent Application Publication No. 10-2011-0047340 (Patent Document 1) discloses a method of producing a nanofiber composite yarn. In the case of Patent Document 1, a method of producing a nanofiber-containing nanofiber composite yarn has been proposed, in which a spinning web composed of polymer nanofibers having a fiber diameter of less than 1 μm is laminated by the technique proposed by the present inventor and then slitted to produce a nanofiber tape yarn, and then the nanofiber tape yarn is conjugated and twisted by a twisting machine. Patent Document 1 is conceptually limited to techniques for a method of manufacturing a nanofiber-only composite yarn and a method of producing a covering yarn.

The present inventor has completed the present invention by innovatively improving the manufacturing technology of the nanofiber composite yarn proposed in Patent Document 1 to improve the continuous productivity and practicality of the nanofiber-based false twist yarn, and by utilizing the advantages of lightweight, wide specific surface area, moisture permeability, water resistance, and functionalization of nanofibers and realizing the physical and chemical properties of existing materials simultaneously, via convergence of a nanofiber-only twist yarn and the conventional spinning yarn or synthetic fiber yarn.

SUMMARY OF THE INVENTION

Technical Problem

The present invention has been proposed in order to improve the conventional physical properties of conventional materials by fusing or converging the nanofiber yarns alone or existing fiber yarns, in which the nanofibers are electrospun during the manufacture and manufactured in a roll form by winding after passing through a dry and calender process. In this case, the shape of the manufactured rolls is mostly 500 meters (M) or so long in terms of handling and processing characteristics, and a primary slitting is performed so as to meet the width of the slitter before a precision slitting process (a secondary slitting) for manufacturing false twist yarns.

Precision slitting of the primary slitted sample causes the work to be terminated within a few minutes. As a result, the continuity of the work is lowered and a process loss occurs. In order to improve the workability and quality, the primary slitted sample is bonded and thus there is a need to extend the length at the maximum, and it is necessary that the joint is not cut off in subsequent processes.

Accordingly, the present invention has been made to solve the above-mentioned problems, and it is an object of the present invention to provide a polymer nanofiber based composite false twist yarn that enables continuous processing by bonding primary slitted nanofibers for continuous manufacturing of a nanofiber false twist yarn and a method of manufacturing the same.

Another object of the present invention is to provide a polymer nanofiber based composite false twist yarn which can be used as a base material for an industrial field by improving physical properties such as strength and tenacity due to heat fixation or hot stretching of a nanofiber tape yarn or false twist yarn and a method of manufacturing the same.

Another object of the present invention is to provide a nanofiber based composite false twist yarn capable of further expanding the use of the nanofiber by improving physical properties through fusion and convergence with existing materials, and a method of manufacturing the same.

Technical Solution

According to an aspect of the present invention, there is provided a method of manufacturing a nanofiber based composite false twist yarn, the method comprising: preparing a spinning solution by dissolving a fiber-forming polymer material in a solvent; electrospinning the spinning solution to obtain a polymer nanofiber web having an average diameter of less than 1 μm; laminating the polymer nanofiber web to obtain a polymer nanofiber membrane; forming a plurality of slitting rolls by primary-slitting the polymer nanofiber membrane; bonding the nanofiber membrane between the plurality of slitting rolls to form a large-diameter slitting roll; secondary-slitting the large-diameter slitting roll to obtain a nanofiber tape yarn; and obtaining a composite false twist yarn by composite-false-twisting the nanofiber tape yarn or a false twist yarn obtained by false-twisting the nanofiber tape yarn with a natural fiber yarn or a synthetic fiber yarn.

Hereinafter, a method of manufacturing a nanofiber based composite false twist yarn according to an embodiment of the present invention will be described in detail.

First, a fiber-forming polymer material is dissolved in an appropriate solvent to be made to a spinnable concentration. Then, a nanofiber having a diameter of less than 1 μm is electrospun on a transfer sheet by using an electrospinning apparatus so as to have a basis weight of 0.5 gsm (gram per square meter) to 100 gsm to thus produce a nanofiber web. Here, the basis weight is defined as the amount of spinning per unit area of the polymer.

Examples of the polymer that can be used in an embodiment of the present invention may be configured by using one or complexing two or more selected from the group consisting of polyvinylidene fluoride (PVDF), nylon, nitrocellulose, polyurethane (PU), polycarbonate (PC), polystryene (PS), polyacrylonitrile (PAN), polylatic acid (PLA), polylactic-co-glycolic acid (PLGA), polyethyleneimine (PEI), polypropyleneimine (PPI), polymethylmethacrylate (PMMA), polyvinylcholide (PVC), polyvinylacetate (PVAc), polystyrene divinylbenzene copolymer, polyvinyl alcohol (PVA), and polyvinyl pyrrolidone (PVP). Any fiber-forming polymers that can be manufactured in a fibrous form by electrospinning may include thermoplastic or thermosetting polymers. Therefore, the polymer usable in an embodiment of the present invention is not particularly limited to the above-mentioned polymer material.

In addition, the solvent which can be used in an embodiment of the present invention may employ one or a mixture of two or more selected from the group consisting of dimethylformamide (DMF), dimethylacetamide (DMAc), tetrahydrofuran (THF), acetone, alcohols, chloroform, dimethyl sulfoxide (DMSO), dichloromethane, acetic acid, formic acid, N-methylpyrrolidone (NMP), fluoric alcohols, and water.

When the basis weight of the polymer used is less than 0.5 gsm, the handling property is lowered and the slitting process tends to be unstable. When the basis weight of the polymer used is more than 100 gsm, the subsequent laminating process is not smoothly performed, and the process cost increases. In addition, the diameter of the final yarn obtained after a false-twisting process gets thicker.

The method of obtaining the nanofiber membrane by laminating the nanofiber web may be performed by at least one of pressurizing, calendering, heat treatment, rolling, thermal bonding, and ultrasonic bonding.

The nanofiber membrane obtained by the laminating is obtained as a roll-shaped membrane by winding both a nanofiber membrane and a transfer sheet, or winding only the nanofiber membrane alone by separating the nanofiber membrane from the transfer sheet, with a winder and a rewinder. The thus-obtained nanofiber membrane is primarily slitted in accordance with the width of a precision slitter to form a plurality of slitting rolls, and a slitting roll and another slitting roll are bonded to each other for continuity of a precision slitting operation, and thus are wound on a roll, thereby forming a large-diameter slitting roll of at least 500M.

Here, it is preferable to bond junctions of the nanofiber membranes between the primarily slitted slitting rolls as narrowly as possible, and the bonding method may be performed by various methods such as thermal bonding, ultrasonic bonding, pressing, and rolling. The width of the junctions is preferably in the range of 0.5 mm to 1 mm. If the width of the junctions is less than 0.5 mm, it may cause yarn breakage in the following precision slitting and false-twisting process. If the width of the junctions exceeds 1 mm, there is a possibility that the junctions protrude during false twisting, resulting in deterioration of the merchantability.

After the primary slitting, the large-sized large-diameter slitting roll is fixed to fit a precision slitter, and then the secondary slitting is performed to obtain a tape yarn composed of nanofibers. The production of the nanofiber tape yarn may be performed by various methods such as cutting and slitting, and the width of the nanofiber tape yarn is preferably set in the range of 0.1 mm to 5 mm.

When the slitting is performed so that the width of the nanofiber tape yarn is less than 0.1 mm, it is difficult to smoothly cut the nanofiber tape yarn, and the probability of occurrence of yarn breakage during tension and twisting is increased. Further, when the slitting is performed so that the width of the nanofiber tape yarn exceeds 5 mm, the probability of occurrence of nonuniform twist in the false twisting step becomes high. Therefore, the nanofiber tape yarn preferably has a basis weight of 0.5 gsm to 100 gsm and a width of 0.1 mm to 10 mm.

The false-twisting is preferably performed to the ultimate purpose by crepe-hard-twisting the nanofiber or the conventional fiber yarn from a low twist yarn at a T/M (twisting/meter) of not more than 500 (at 5° to 15° in the twisting angle) to a crepe hard twist yarn at a T/M of not less than 2,500 (at 30° to 45° in the twisting angle) in a range where the nanofiber or the conventional fiber yarn is not broken by using a two-for-one twister, a fancy twister, a composite twister, a covering twister, etc.

In particular, in the case of a composite false twist yarn, a variety of kinds of yarns can be used to be false-twisted with natural fibers such as cotton, silk, wool, and Korean paper, or with synthetic fibers such as PET, nylon, PP, PU, PLA and PLGA, to fit for a usage, but the present invention is not particularly limited thereto.

In the method of stretching the nanofiber tape yarn, the false twist yarn or the composite false twist yarn by applying a tension to the same, a tension may be applied by passing the nanofiber tape yarn or the false twist yarn between an up-disk tensioner and a down-disk tensioner. In this case, in order to prevent loosening after false twisting, it is possible to carry out heat treatment at a temperature equal to or lower than the melting point of the material so as to simultaneously perform stretching and thermal fixing.

The nanofiber based composite false twist yarn obtained according to the above-described method includes: a nanofiber tape yarn including at least one bonding portion or a false twist yarn which is obtained by false twisting the nanofiber tape yarn; and a natural fiber yarn or a synthetic fiber yarn that is composite-false-twisted with the nanofiber tape yarn or the false twist yarn, wherein the nanofiber tape yarn is made of a nanofiber web that is obtained by integrating polymer nanofibers made of a fiber-forming polymer material and having an average diameter of less than 1 μm thereby having fine pores.

Advantageous Effects

As described above, in some embodiments of the present invention, the continuous process can be performed by bonding the nanofiber membranes between the primary slitting rolls for continuous production of the nanofiber false twist yarn, thereby improving the productivity.

In addition, in some embodiments of the present invention, the nanofiber tape yarn or false twist yarn is thermally fixed or hot-rolled to improve physical properties such as strength and elasticity, and is excellent in weaving and knitting, to thus be used as a base material for industrial field.

That is, since the nanofiber based composite false twist yarn according to some embodiments of the present invention has a high porosity per unit area, it is possible to get lightweight in the production of work pieces such as weaving and knitting, a surface area is large to enlarge the contact area, and it is possible to make various functionalization such as drug loading, to thus have the effect of providing a function as a basic material throughout the industrial field.

Further, in some embodiments of the present invention, the use of nanofibers can be further expanded by improving physical properties through fusion with existing materials. In some embodiments of the present invention, a high-performance filament yarn can be provided, in which the high-performance filament yarn has various shapes and functions such as tensile strength, elasticity, and thickness by composite-twisting the nanofiber false twist yarn with natural or synthetic fibers.

BEST MODE

Figure 1:
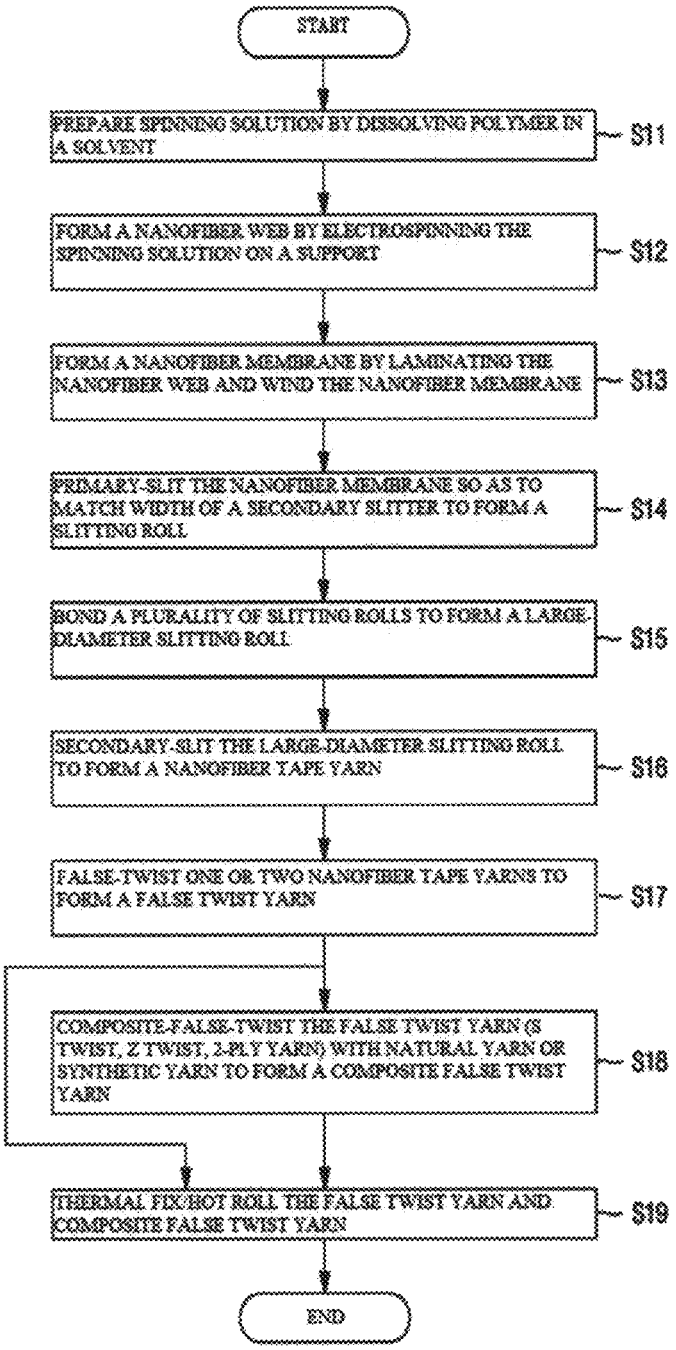
FIG. 1 is a flowchart showing a method of manufacturing a nanofiber based composite false twist yarn according to an embodiment of the present invention.

Hereinafter, embodiments of the present invention will be described in detail with reference to the accompanying drawings. The sizes and shapes of the components shown in the drawings may be exaggerated for clarity and convenience.

Referring to FIG. 1, a method of manufacturing a composite false twist yarn containing nanofibers according to an embodiment of the present invention includes: preparing a solution at a spinnable concentration by dissolving a fiber-forming polymer in an appropriate solvent; after transferring the solution to a spinner of an of electrospinning device and then applying a high voltage to a nozzle of the spinner, electrospinning the solution to have a basis weight of 0.5 gsm to 100 gsm; after laminating the electrospun result, primarily slitting the laminated result; and secondarily precision-slitting the primarily slitted result so as to have a width of 0.1 mm to 5 mm to obtain a nanofiber tape yarn composed of nanofibers.

The thus-obtained nanofiber tape yarn is right-handed twisted (S twist) or left-handed twisted (Z twist) by using a conventional twister or the like, to obtain a false twist yarn composed of nanofibers.

Thereafter, the above-mentioned nanofiber false twist yarn is composite-twisted with an existing material to produce a nanofiber based composite false twist yarn. The manufactured nanofiber tape yarn or nanofiber-only false twist yarn is thermally fixed or hot-rolled so as not to be untwisted through a post-treatment process, thereby improving the physical properties of the nanofiber.

FIG. 1 is an overall flowchart showing a method of manufacturing a nanofiber based composite false twist yarn according to an embodiment of the present invention.

Respective steps of the overall flowchart will be described in detail below.

(Preparation of Spinning Solution)

A polymer is dissolved at a spinnable concentration by using an appropriate solvent to prepare a spinning solution (S11). In some embodiments of the present invention, any polymer material is not particularly limited as long as it is a polymer that is formed as nanofibers by electrospinning a thermosetting polymer or a thermoplastic polymer.

The content of the polymer material in the preparation of the spinning solution is suitably about 5 wt % to about 50 wt %. When the content of the polymer material is less than 5 wt %, the nanofibers are not formed but are sprayed in a bead form, and thus it is difficult to form a membrane. Meanwhile, when the content of the polymer material exceeds 50 wt %, the viscosity of the spinning solution is too high, and thus the spinnability is poor to cause it difficult to form fibers. Therefore, although there is no particular restriction on the preparation of the spinning solution, it is preferable to control the morphology of the fiber at a concentration that is easy to form a fibrous structure.

(Forming of Nanofiber Web)

The spinning solution is transferred to a spin pack using a metering pump. Here, a voltage is applied to the spinning pack using a high voltage regulating device to conduct electrospinning (S12). In this case, the voltage to be used can be adjusted from 0.5 kV to 100 kV, and the collector can be grounded or charged with negative (−) polarity. In the case of the collector, it is advisable to use a suction collector in order to smooth focusing of fibers during spinning.

It is also preferable to adjust the distance between the spin pack and the collector to 5 cm to 50 cm. It is preferable that a discharge amount during spinning should be equally discharged and spun by using a metering pump, and the spinning is performed in an environment of a relative humidity of 30% to 80% in a chamber capable of controlling temperature and humidity during spinning.

In some embodiments of the present invention, a nanofiber web composed of polymer nanofibers is formed by electrospinning nanofibers on one side of a transfer sheet (or a support), in which the transfer sheet transports a spinning solution from a spin pack through a lower-side collector, by using a transferring method. The polymer nanofiber web collected on the transfer sheet is integrated with the polymer nanofibers to have three-dimensional micropores.

The transfer sheet can be made of, for example, a paper material (release paper), or a nonwoven fabric made of a polymer material which is not dissolved by a solvent contained in the spinning solution during spinning thereof, and a polyolefin film such as PE or PP.

When the polymer nanofiber web itself is used alone, it is difficult to carry out the drying process, the laminating process and the winding process while being conveyed at a high transfer speed because the tensile strength is low. In addition, it is difficult to continuously carry out the subsequent process with the high transfer speed after the production of the polymer nanofiber web. However, when the above-mentioned transfer sheet is used, the process treatment speed can be greatly increased by providing a sufficient tensile strength.

In addition, when a polymer nanofiber web is used alone, electrostatic phenomenon causes the phenomenon to adhere to other objects, thereby deteriorating the workability. However, this problem can be solved when a transfer sheet is used.

Furthermore, the electrospun nanofibers have a phenomenon in which integration occurs in the collector and a phenomenon that is laminated along the pattern of the integrated portion. Therefore, in order to produce a porous polymer nanofiber web of nanofibers having good uniformity (pore size, air permeability, thickness, weight, etc.), it is preferable to spin the nanofibers on a transfer sheet such as paper and peel off the spun nanofibers after the subsequent process.

(Laminating of Nanofiber Web)

The prepared polymer nanofiber web is laminated by various methods such as compression, rolling, thermal bonding, ultrasonic bonding, or calender bonding, to produce a nanofiber membrane having a basis weight of 0.5 gsm to 100 gsm (S13). In some embodiments of the present invention, laminating is a step of forming the nanofiber web into a film by pressing and fixing the spun individual nanofibers by heat treatment or ultrasonic wave so that they cannot move independently.

When the basis weight is less than 0.5 gsm, the probability of occurrence of defects at the time of handling or slitting is high, and when the basis weight is more than 100 gsm, the production cost is increased, so that the basis weight is preferably 0.5 gsm to 100 gsm.

In addition, laminating can be carried out with heat treatment, and preferably carried out at a temperature in the range of 50° C. to 250° C. in which the polymer used is not melted. If the temperature is less than 50° C., the fusion between the nanofibers is unstable due to too a low heat treatment temperature, or if the polymer having a high glass transition temperature is hardly fused between the nanofibers, there is a high possibility that the subsequent slitting does not proceed smoothly at the time of producing a tape yarn. Also, when the heat treatment temperature exceeds 250° C., it is undesirable that there is a high possibility that the polymer constituting the nanofiber is melted and thus the fibrous structure is lost.

(Winding and Primary Slitting of Nanofiber Membranes)

Since the nanofiber membrane is manufactured on a transfer sheet, the nanofiber membrane is wound or rolled simultaneously with the transfer sheet after laminating, or the nanofiber membrane is rolled alone and manufactured in a roll form through winding and unwinding while separating the transfer sheet. In this case, the width of the nanofiber membrane manufactured in a roll form can be variously manufactured from 500 mm to 2,000 mm according to the spinning equipment, but the length thereof is about 500 meters or so. The roll-type nanofiber membrane is primarily slitted together with a bobbin so as to match the width of a precision slitter, by using the same equipment as that shown in FIG. 3B to form a plurality of slitting rolls (S14).

The plurality of slitting rolls obtained by the primary slitting are rolled through the bonding of the nanofiber membrane between the plurality of slitting rolls and through winding and unwinding thereof, into 500 meters or more, preferably, 1,000 meters or more, so that a secondary slitting operation at the precision slitter is continuously performed for a predetermined period of time in order to improve productivity, to form a large-diameter slitting roll (S15).

(Production of Nanofiber Tape Yarn by Secondary Slitting of Nanofibers)

The large-diameter slitting roll obtained by enlarging the plurality of primarily slitted slitting rolls is slitted to have a width of 0.1 mm to 5 mm by various methods using a precision slitter such as a cutter or a slitter to form a nanofiber tape yarn composed of nanofiber membranes (S16).

When the width of the slitted nanofiber tape yarn is made less than 0.1 mm, the width thereof is too small to smoothly cut the slitted nanofiber tape yarn by using the slitter, as well as the probability of occurrence of yarn breakage in tension and twisting is increased. In addition, when the width thereof is more than 5 mm, the possibility of nonuniform twist in the twisting step increases, and the thickness of the twisted yarn becomes thick, resulting in deterioration of the merchantability as a fiber yarn. Therefore, the nanofiber tape yarn preferably has a basis weight of 0.5 gsm to 100 gsm and a width of 0.1 mm to 5 mm.

(Production of Polymer Nanofiber False Twist Yarns)

The prepared nanofiber tape yarn is twisted through a twister to give the right handed twist (S twist) or the left handed twist (Z twist) to the nanofiber tape yarn, to thereby impart a twisting (T/M; twisting/meter) to the nanofiber tape yarn (S17). Here, it is necessary to implement a twisting (T/M) by performing low-twisting a polymer with T/M 500 or less or crepe-hard-twisting a polymer with T/M 2500 or more to meet the kind of polymer or the end purpose.

Further, as a method of imparting tension to a nanofiber tape yarn, it is possible to impart tension to the nanofiber tape yarn by passing the nanofiber tape yarn between an up-disk tensioner and a down-disk tensioner, and depending on the type of the polymer, hot rolling or thermal fixing can be carried out in a temperature range between the glass transition temperature (Tg) and the melting temperature (Tm).

Further, two strands of the twisted nanofiber false twist yarn twisted with the right handed twist (S twist) or the left handed twist (Z twist) may be joined together and composite-twisted to form a twin yarn composed of the nanofibers (S17).

Meanwhile, a nanofiber tape yarn and another nanofiber tape yarn may be folded together and continuously subjected to the twisting process. In this case, the nanofiber tape cannot only use homogeneous polymers, but also can join a different type of nanofiber tape yarns.

(Production of Nanofiber Composite False Twist Yarns)

The prepared nanofiber false twist yarns (S twist, Z twist, or 2-ply yarn) can be composite-false-twisted with natural fibers or synthetic fibers to produce a composite false twist yarn (S18). In this case, cotton, silk, wool, cellulose and the like can be selected as natural fibers for the final purpose, and PET, nylon, PP, PE, PVC, PU, PTFE, PVDF, etc., can be selected as synthetic fibers, to suit the final purpose, to then be composite-false-twisted, and the synthetic fibers are not limited to specific materials.

(Post-Treatment of Nanofiber False Twist Yarn)

The produced nanofiber-only false twist yarns or composite false twist yarns may be subjected to perform a process such as hot rolling or thermal fixing or the like so as not to be untwisted or to impart strength thereto (S19). Various methods such as hot rolling and cold rolling can be used as the rolling method, and it is preferable to use the thermal fixing in a temperature range in which the twisting is not untwisted depending on the material used. The preferred hot rolling or thermal fixing is carried out in a temperature range between the glass transition temperature (Tg) and the melting temperature (Tm) of the polymer used. Further, the hot rolling and thermal fixing process can be carried out not only in the post-treatment of the composite false twist process, but also in the pre-treatment thereof.

Hereinafter, the present invention will be described in more detail with reference to embodiments. However, the embodiments are only for illustrating the present invention and the scope of the present invention should not be limited by these embodiments.

EXAMPLES

(Example 1) Manufacturing of PVDF Nanofiber Web and Primary Slitting

PVDF polymers are dissolved in a mixed solvent (DMAc/Acetone=90/10 wt %) so as to be 20 wt % to prepare a spinning solution. This spinning solution was transferred to a spinning nozzle by using a metering pump, and was spun under the conditions of an applied voltage of 25 kV, a distance between a spinneret and a collector of 20 cm, a discharging amount of 0.05 cc/g·hole per minute, a spinning temperature of 30° C., and a relative humidity of 60%, and a normal atmospheric pressure, to produce a nanofiber web.

Figure 2:
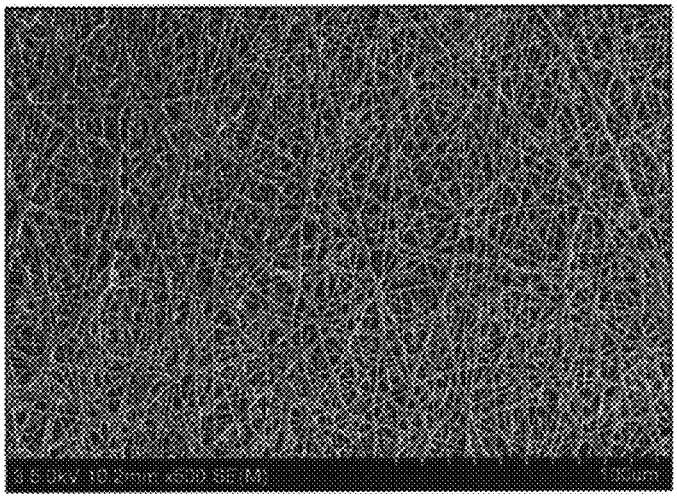
FIG. 2 is a scanning electron micrograph (SEM) image of a PVDF nanofiber web prepared according to an example 1 of the present invention.

FIG. 2 is a scanning electron microscope (SEM) image of the PVDF nanofiber web obtained according to an embodiment of the present embodiment. It can be seen that the nanofiber web is composed of uniform PVDF nanofibers having an average diameter of about 300 nm.

The basis weight of the nanofiber web was about 5 gsm. The nanofiber web was calendered at a pressure of 100 g/cm$^2$ by using a roller heated at 150° C. to obtain a PVDF nanofiber membrane having a length of about 500 meters and a thickness of 10 μm and then PVDF nanofiber membrane alone was rolled. The thus obtained nanofiber membrane was primarily slitted in accordance with the width of a second precision slitter to prepare a plurality of slitting rolls and then bonded between the slitting rolls through the nanofiber membrane using an ultrasonic bonding device to have a bonding surface of 1 mm, and then rewound to obtain a large-diameter slitting roll having a length of 500 meters or more in length.

Figure 3A:
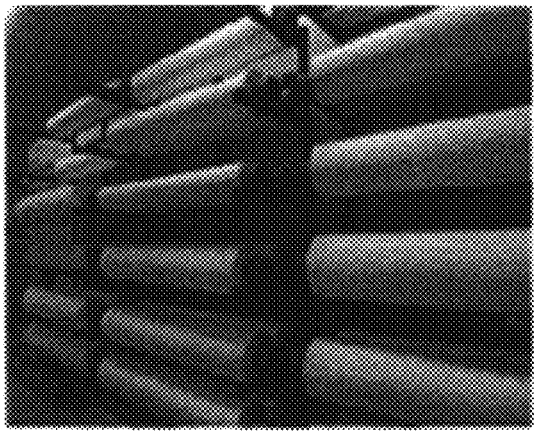
FIG. 3A is a photograph of a result obtained by rolling PVDF nanofiber membranes obtained by calendering the PVDF nanofiber web of FIG. 2.
Figure 3B:
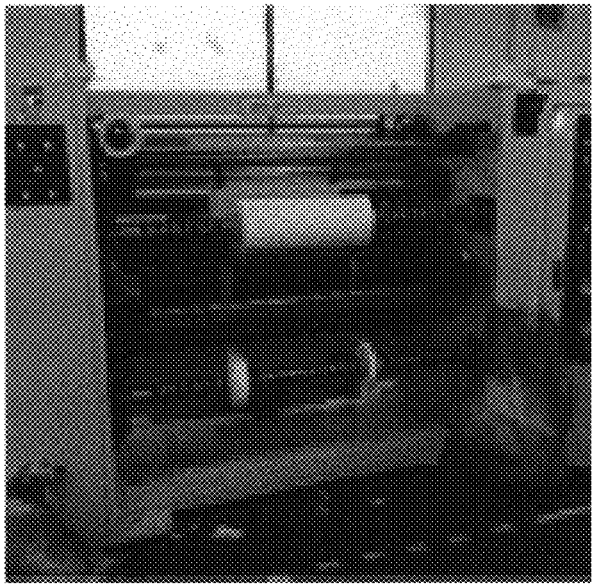
FIG. 3B is a photograph illustrating a process of primarily slitting the roll-type nanofiber membrane by using a primary slitter.
Figure 3C:
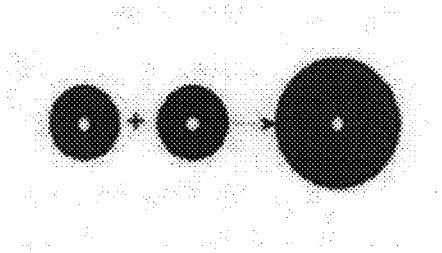
FIG. 3C is a conceptual view showing a process of obtaining a large-diameter slitting roll by bonding a nanofiber membrane between a slitting roll and another slitting roll.
Figure 3D:
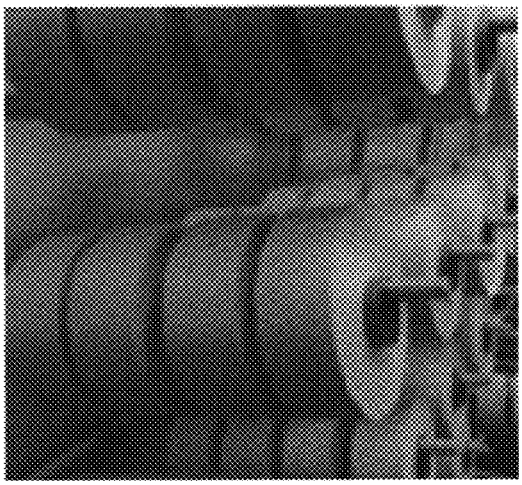
FIG. 3D is a photograph of a large-diameter slitting roll.

FIG. 3A is a photograph of a result obtained by rolling PVDF nanofiber membranes obtained by calendering the PVDF nanofiber web of FIG. 2, FIG. 3B is a photograph illustrating a process of primarily slitting the roll-type nanofiber membrane by using a primary slitter, FIG. 3C is a conceptual view showing a process of obtaining a large-diameter slitting roll by bonding a nanofiber membrane between a slitting roll and another slitting roll, and FIG. 3D is a photograph of a large-diameter slitting roll.

(Example 2) Manufacturing of PVDF Nanofiber Tape Yarn

Figure 4A:
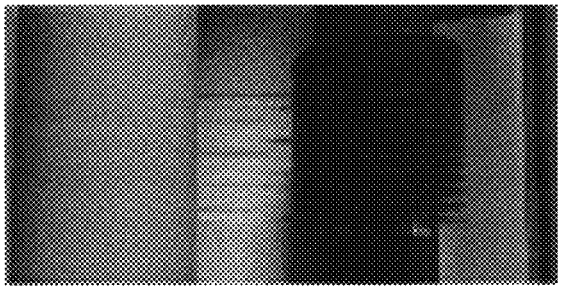
FIG. 4A is a photograph showing a secondary slitting process of the large-diameter slitting roll using a precision slitter.
Figure 4B:
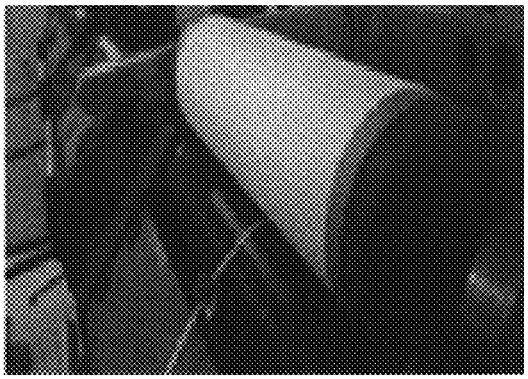
FIG. 4B is a nanofiber tape yarn wound on a flat bobbin.
Figure 4C:
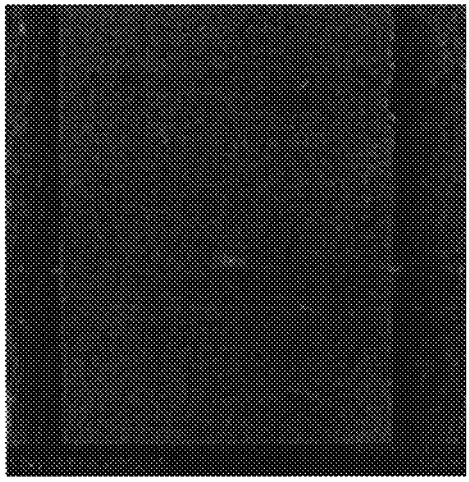
FIG. 4C is a SEM image of a nanofiber tape yarn.
Figure 4D:
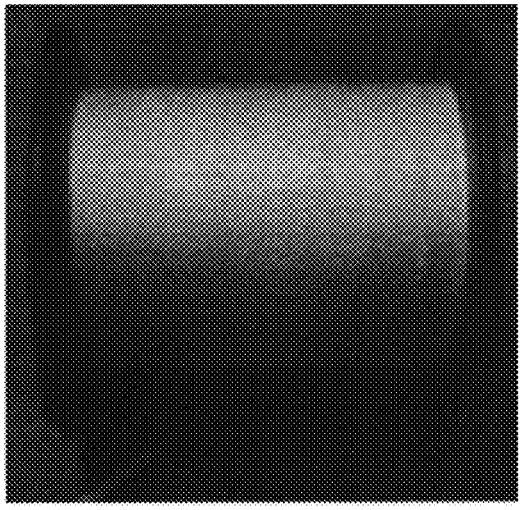
FIG. 4D is a photograph of a nanofiber tape yarn wound on an "H" bobbin.

The large-diameter slitting roll prepared in Example 1 was subjected to secondary slitting using a secondary precision slitter having a knife interval of 1.5 mm and having twelve knives (see FIG. 4A), and then to rolling with a flat bobbin and an H bobbin (see FIGS. 4B and 4D) to obtain a PVDF nanofiber tape yarn composed of a nanofiber membrane. FIG. 4C shows a scanning electron microscope (SEM) image of the nanofiber tape yarn, and it was confirmed that the nanofiber tape yarn was precisely slitted at a width of 1.5 mm.

(Example 3) Manufacturing of Nanofiber False Twist Yarns and Composite False Twist Yarns The nanofiber tape yarn prepared in Example 2 was subjected to twisting of right handed twist (S twist) with T/M 500 using a two-for-one twister to produce a false twist yarn of nanofibers alone.

Figure 5A:
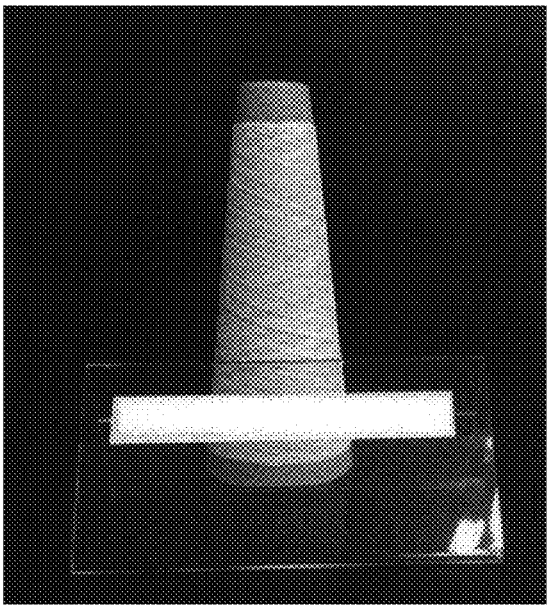
FIG. 5A is a photograph of a cone sample of a two-for-one false twist yarn manufactured by using a two-for-one twister.
Figure 5B:
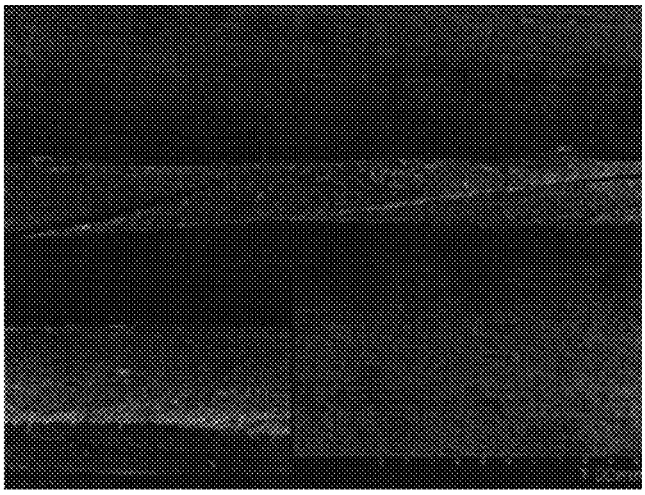
FIG. 5B is a SEM image of a two-for-one false twist yarn.

FIGS. 5A and 5B show a cone sample image and a scanning electron microscope (SEM) image of a two-for-one false twist yarn manufactured using a two-for-one twister, respectively. As can be seen from the SEM image of FIG. 5B, the false twist yarn composed of the nanofibers alone could be confirmed.

Further, the PVDF nanofiber tape yarn prepared in Example 2 was false-twisted in the right handed twist (S twist) and the left handed twist (Z twist), respectively, at a ratio of T/M 500, to obtain the false-twisted nanofiber false twist yarn and then the false-twisted nanofiber false twist yarn was composite-false-twisted at a ratio of T/M 1000 by using a composite twister, to produce a composite false twist yarn of the nanofibers alone.

Figure 6A:
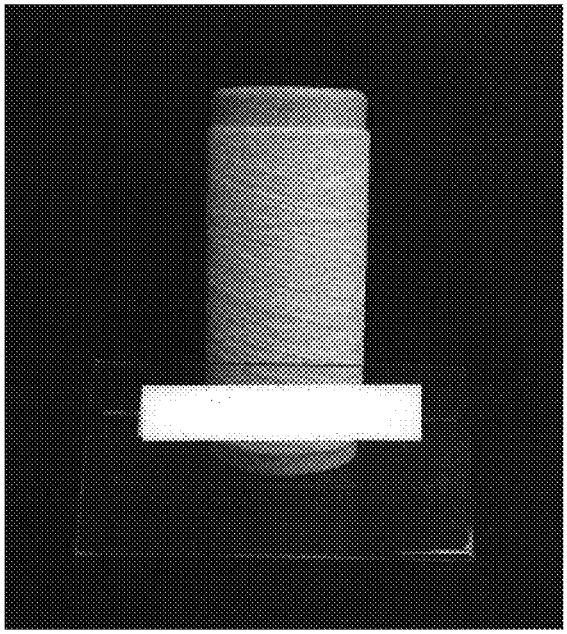
FIG. 6A is a photograph of a sample of a nanofiber-only composite false twist yarn obtained by composite-twisting a nanofiber false twist yarn whose right handed twist (S twist) and left handed twist (Z twist) are false-twisted at T/M 500, respectively, under the condition of T/M 1000 by using a composite twister.
Figure 6B:
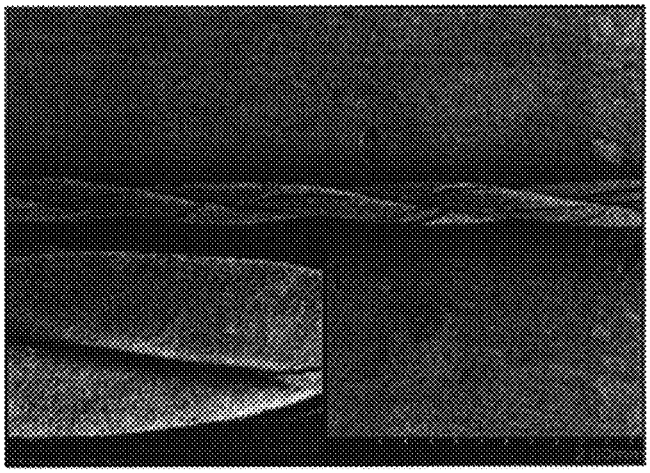
FIG. 6B is a SEM image of a nanofiber composite false twist yarn (2-ply yarn).

FIG. 6A is a photograph of a sample of a nanofiber-only composite false twist yarn obtained by composite-twisting a nanofiber false twist yarn whose right handed twist (S twist) and left handed twist (Z twist) are false-twisted at T/M 500, respectively, under the condition of T/M 1000 by using a composite twister, and FIG. 6B is a SEM image of a nanofiber composite false twist yarn (2-ply yarn). As shown in FIG. 6B, it was confirmed that the nanofiber tape yarns were 2-folded in a composite manner.

(Example 4) Manufacturing of a Composite False Twist Yarn of Nanofibers and Synthetic Fibers The PVDF nanofiber tape yarn prepared in Example 2 was composite-false-twisted with a nylon 20d monofilament yarn under the condition of T/M 1000 to prepare a composite false twist yarn of nanofibers and synthetic fibers.

Figure 7A:
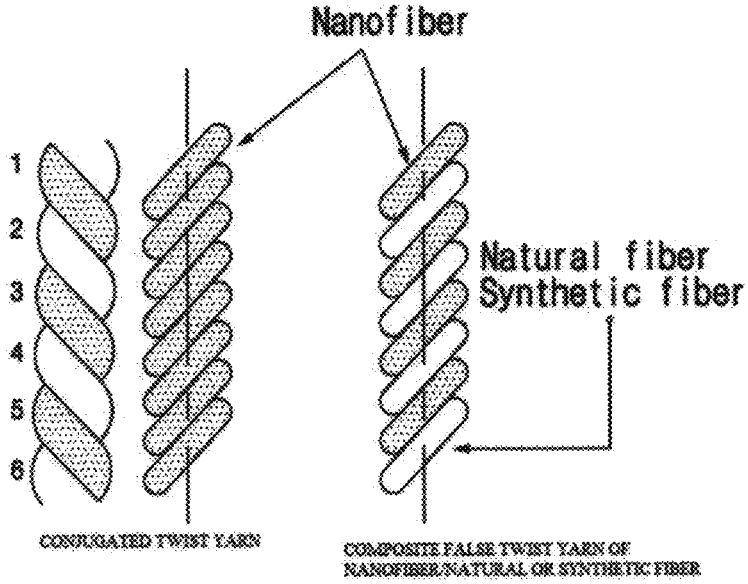
FIG. 7A is a schematic view of a composite false twist yarn manufacturing process of natural and synthetic fibers and nanofiber tape yarns.
Figure 7B:
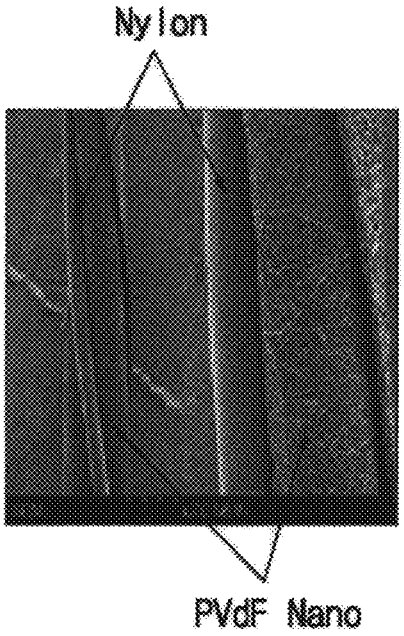
FIG. 7B is a SEM image of a composite false twist yarn obtained by composite-false-twisting a PVDF nanofiber tape yarn and a nylon 20d monofilament yarn under the condition of T/M 1000.

FIG. 7A is a schematic view of a composite false twist yarn manufacturing process of natural and synthetic fibers and nanofiber tape yarns. FIG. 7B is a SEM image of a composite false twist yarn obtained by composite-false-twisting a PVDF nanofiber tape yarn and a nylon 20d monofilament yarn under the condition of T/M 1000. As shown in FIG. 7B, it was confirmed that the composite false twisting between the nanofibers and the synthetic fibers was accomplished.

Figure 8:
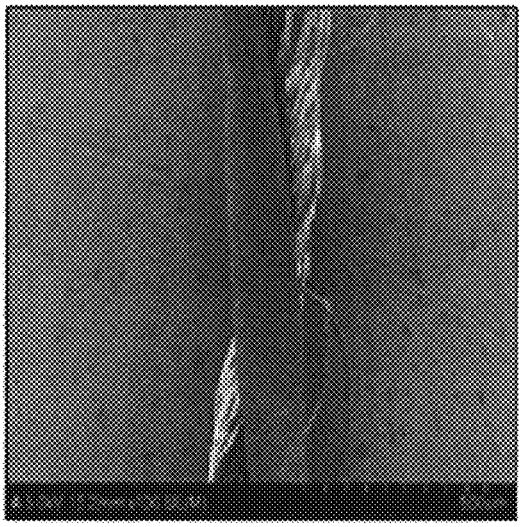
FIG. 8 is a SEM image of a composite false twist yarn obtained by composite-false-twisting a PVDF nanofiber tape yarn and cotton of count of yarns 60 (D).

(Example 5) Manufacturing of a Composite False Twist Yarn of Nanofibers and Natural Fibers The PVDF nanofiber tape yarn and cotton No. 60 prepared in Example 2 was composite-false-twisted with cotton of count of yarns 60 (D), by the same method as in Example 4 to obtain a composite false twist yarn in which nanofibers and natural fibers were composite-false-twisted. FIG. 8 is a SEM image of a composite false twist yarn obtained by composite-false-twisting a PVDF nanofiber tape yarn and cotton of count of yarns 60 (D).

(Example 6) Post-Treatment of Nanofiber Tape Yarn and False Twist Yarn

Figure 9:
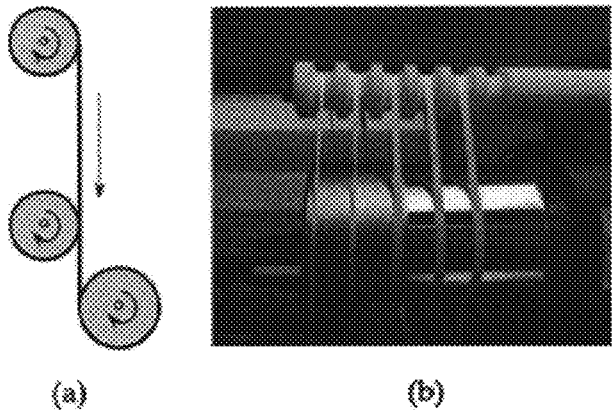
FIG. 9 is (a) a schematic view of the hot rolling of a PVDF nanofiber tape yarn, and (b) a photograph showing a process of performing a hot rolling of a PVDF nanofiber tape yarn slitted at 1.5 mm by varying speeds of an up-disk and a down-disk at 150° C.

The 1.5 mm slitted PVDF nanofiber tape yarn prepared in Example 2 was hot-rolled at a temperature of 150° C. with different speeds of the up and down disks. FIG. 9A is a schematic view of hot rolling, and FIG. 9B is a photograph showing a hot rolling process.

As shown in FIG. 9B, when the hot-rolling process was performed, it was confirmed that the nanofiber tape yarn was thermally stretched and tapered.

Analysis of Tensile Strength and Elasticity

Hereinbelow, the PVDF nanofiber tape yarn (slitting yarn) of Example 2, the false twist yarn (two-for-one twist yarn) of the nanofibers alone of Example 3 obtained by right-handed-twisting (S twist) the PVDF nanofiber tape yarn of Example 2 with the T/M 500 using the two-for-one twister, and the nanofiber-only composite false twist yarn (conjugated twist yarn) obtained by composite-twisting the PVDF nanofiber false twist yarn of Example 2 whose right handed twist (S twist) and left handed twist (Z twist) are false-twisted at T/M 500, respectively, under the condition of T/M 1000 by using a composite twister, were subjected to testing of the tensile strength according to the test standards of KSK0412 shown in the following Table 1. The results are shown in Table 2 below.

TABLE 1

| Type of twist yarns | Type of testers | Distance between clamps | Tensile speed | The number of samples | Test Specification | Count of yarns (D) |
|---|---|---|---|---|---|---|
| Slitting yarns | Constant speed tension type | 25 cm | 30 ± 2 (cm/min) | 5 | KSK0412 | 211.32 |
| two-for-one twist yarns | | | | | | 208.26 |
| conjugated twist yarns | | | | | | 468 |

TABLE 2

| Type of twist yarns | Maximum load (N) | Elongation at maximum load (mm) | Strength of maximum load (gf/den) | Strength at fracture (standard) (gf/den) | Tensile strain at fracture (standard) (%) | Tensile strain at maximum load (%) |
|---|---|---|---|---|---|---|
| Slitting yarns | 1.12 | 257.43994 | 0.54215 | −0.02684 | 108.91198 | 102.97598 |
| two-for-one yarns | 1.05 | 177.43597 | 0.51641 | −0.02206 | 75.59679 | 70.97439 |
| conjugated twist yarns | 2.36 | 331.33062 | 0.51421 | −0.0082 | 140.74104 | 132.53225 |

While the present invention has been particularly shown and described with reference to exemplary embodiments thereof, by way of illustration and example only, it is clearly understood that the present invention is not to be construed as limiting the present invention, and various changes and modifications may be made by those skilled in the art within the protective scope of the invention without departing off the spirit of the present invention.

INDUSTRIAL APPLICABILITY

The present invention relates to manufacturing of a nanofiber based composite false twist yarn that is obtained by twisting a nanofiber-only twist yarn that is obtained by twisting the nanofiber tape yarn or composite-twisting a nanofiber-only twist yarn and a natural fiber or synthetic fiber.

What is claimed is:

1. A method of manufacturing a nanofiber based composite false twist yarn, the method comprising:

preparing a spinning solution by dissolving a fiber-forming polymer material in a solvent;

electrospinning the spinning solution to obtain a polymer nanofiber web, the polymer nanofiber web being formed of polymer nanofibers having an average diameter of less than 1 μm;

laminating the polymer nanofiber web to obtain a polymer nanofiber membrane;

winding the polymer nanofiber membrane to obtain a first rolled polymer nanofiber membrane having a first roll width and a first roll diameter, primary-slitting the first rolled polymer nanofiber membrane to obtain a plurality of second rolled polymer nanofiber membranes each having a second roll width being smaller than the first roll width and the second roll diameter being same as the first roll diameter;

bonding at least two of the second rolled polymer nanofiber membranes to form a third rolled polymer nanofiber membrane having a third roll width being same as the second roll width and a third roll diameter being larger than the second roll diameter;

secondary-slitting the third rolled polymer nanofiber membrane to obtain a nanofiber tape yarn; and obtaining a composite false twist yarn by composite-false-twisting the nanofiber tape yarn or a false twist yarn obtained by false-twisting the nanofiber tape yarn with a natural fiber yarn or a synthetic fiber yarn.

2. The method of manufacturing a nanofiber based composite false twist yarn of claim 1, wherein the first roll width is set according to a width of a precision slitter to which the secondary slitting is performed.

3. The method of manufacturing a nanofiber based composite false twist yarn of claim 1, wherein a bonding portion between the at least two of the second rolled polymer nanofiber membranes is set in a range of 0.5 mm to 1 mm.

4. The method of manufacturing a nanofiber based composite false twist yarn of claim 3, wherein the bonding is performed by any one of thermal bonding, ultrasonic bonding, pressing and rolling.

5. The method of manufacturing a nanofiber based composite false twist yarn of claim 1, wherein the third rolled polymer nanofiber membrane has a length of 500 meters or more.

6. The method of manufacturing a nanofiber based composite false twist yarn of claim 1, wherein the nanofiber tape yarn has a basis weight of 0.5 gsm to 100 gsm and a width of 0.1 mm to 5 mm.

7. The method of manufacturing a nanofiber based composite false twist yarn of claim 1, wherein the false twist yarn is one of a right handed yarn or a left handed yarn of a nanofiber-only tape yarn, and a two-ply yarn obtained by composite-twisting the right handed yarn and the left handed yarn.

8. The method of manufacturing a nanofiber based composite false twist yarn of claim 1, wherein the false twist yarn is a low twist yarn at a T/M (twisting/meter) of not more than 500 or a crepe hard twist yarn at a T/M of not less than 2,500.

9. The method of manufacturing a nanofiber based composite false twist yarn of claim 1, further comprising: hot rolling or thermal fixing the false twist yarn and the composite false twist yarn so as to prevent twist of the false twist yarn and the composite false twist yarn from being loosened.

10. The method of manufacturing a nanofiber based composite false twist yarn of claim 9, wherein the hot rolling or the thermal fixing is performed in a temperature range between a glass transition temperature (Tg) and a melting temperature (Tm) of the fiber-forming polymer material.

11. The method of manufacturing a nanofiber based composite false twist yarn of claim 9, wherein the hot rolling is performed at different speed of up and down disks.

12. A nanofiber based composite false twist yarn comprising:

a nanofiber tape yarn including at least one bonding portion or a false twist yarn which is obtained by false twisting the nanofiber tape yarn; and a natural fiber yarn or a synthetic fiber yarn that is composite-false-twisted with the nanofiber tape yarn or the false twist yarn, wherein the nanofiber tape yarn is made of a nanofiber web having fine pores, the nanofiber web being made of polymer nanofibers, the polymer nanofibers being made of a fiber-forming polymer material and having an average diameter of less than 1 μm.

13. The nanofiber based composite false twist yarn of claim 12, wherein the nanofiber tape yarn is formed by slitting a polymer nanofiber membrane obtained by laminating the nanofiber web.

14. The nanofiber based composite false twist yarn of claim 12, wherein the at least one bonding portion is joined in a range of 0.5 mm to 1 mm, and the nanofiber tape yarn has a basis weight of 0.5 gsm to 100 gsm and a width of 0.1 mm to 5 mm.

15. The nanofiber based composite false twist yarn of claim 12, wherein the false twist yarn is one of a right handed yarn or a left handed yarn of a nanofiber-only tape yarn, and a two-ply yarn obtained by composite-twisting the right handed yarn and the left handed yarn.

* * * * *